US006297714B1

(12) United States Patent
Hirtzlin et al.

(10) Patent No.: US 6,297,714 B1
(45) Date of Patent: Oct. 2, 2001

(54) DEVICE FOR TRANSMISSION AND/OR RECEPTION OF SIGNALS

(75) Inventors: Patrice Hirtzlin, Rennes; Chaoying Guo, Illkirch; Christopher Howson, Rennes, all of (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/317,801

(22) Filed: May 24, 1999

(30) Foreign Application Priority Data

May 29, 1998 (FR) ..... 98 06787

(51) Int. Cl.[7] ..... H01P 1/213; H01P 5/12
(52) U.S. Cl. ..... 333/135; 333/137
(58) Field of Search ..... 333/132, 134, 333/135, 136, 137

(56) References Cited

U.S. PATENT DOCUMENTS 4,333,076 * 6/1982 Cachier ..... 333/137 X
4,777,654 * 10/1988 Conti ..... 455/81
4,853,657 * 8/1989 Cruchon et al. ..... 333/137
5,384,557 * 1/1995 Yoshida et al. ..... 333/137 X
5,926,129 * 7/1999 Ephgrave et al. ..... 342/200

FOREIGN PATENT DOCUMENTS 0398688A 11/1990 (EP) ..... H04Q/7/00
0552944A 7/1993 (EP) ..... H01P/1/161

OTHER PUBLICATIONS

Patent Abstracts of Japan, vol. 18, No. 646 (E–1641), Dec. 8, 1994–&JP 06 252609A (Toshiba Corp), Sep. 9, 1994.
Patent Abstracts of Japan, vol. 97, No. 12, Dec. 25, 1997 & JP 09 219664A (NEC Corp), Aug. 19, 1997.
French search report dated Feb. 12, 1999.

* cited by examiner

*Primary Examiner*—Robert Pascal
*Assistant Examiner*—Barbara Summons
(74) *Attorney, Agent, or Firm*—Joseph S. Tripoli; Kuniyuki Akiyama

(57) ABSTRACT

The invention relates to a device for transmission and/or reception of signals. It comprises a first waveguide (9) for the reception/transmission of signals and a second waveguide (23) for the transmission of a signal originating from an oscillator of the reception board, for example, to the transmission board. Particular application to the field of broadcasting signals exchanged between a station and a dwelling, in the scope of the MMDS, LMDS or MVDS, or between a satellite and a dwelling, in the scope of a satellite telecommunications system.

15 Claims, 6 Drawing Sheets

DEVICE FOR TRANSMISSION AND/OR RECEPTION OF SIGNALS

FIELD OF THE INVENTION

The present invention relates to a device for transmission and/or reception of signals.

BACKGROUND OF THE INVENTION

Telecommunication services of the wire-free interactive type are developing rapidly. These services relate to telephony, facsimile transmission, television, in particular digital television, the so-called "multimedia" sector and the internet network. The equipment for these mass-market services has to be made available at a reasonable cost. This is so, in particular, as regards the user's receiver/transmitter which has to communicate with a server, most often via a telecommunication satellite, or in the scope of an MMDS (multi-point multi-channel distribution system), LMDS (local multi-point distribution system) or MVDS (multi-point video distribution system). These communication methods generally use the microwave range. For example, in the scope of the MMDS, frequency bands of the order of 40 GHz are used.

For these frequency ranges, a waveguide receiver and a wavelength transmitter can be used, the two waveguides being separate.

FIG. 1 represents a diagram of a device 1 for the transmission/reception of signals, in general located outside a dwelling (not shown). This device 1 comprises, on the one hand, a reception antenna 2, connected by a reception path 3 to a unit 4 for conversion to intermediate frequency and, on the other hand, a transmission antenna 5, connected by a transmission path 6 to a unit 7 for frequency conversion to a higher frequency. The two units 4, 7 are connected by a coaxial cable 80 to a set inside the dwelling. Each unit 4, 7 respectively comprises a mixer $\mathbf{4}_1$, $\mathbf{7}_1$ connected to a local oscillator $\mathbf{4}_2$, $\mathbf{7}_2$. The transmission antenna makes it possible to employ a return path to the transmitter.

The device which has just been described has the disadvantage of requiring, in particular, two local oscillators in the conversion units 4, 7 of the outside set, one for reception and the other for transmission.

SUMMARY OF THE INVENTION

The object of the invention is to avoid the drawbacks of the prior art cited.

It relates to a device for transmission and/or reception of signals, comprising:

- a first waveguide for the operation in a first frequency band and the operation in a second frequency band,
- a first frequency conversion circuit and a second frequency conversion circuit coupled with the first waveguide for the frequency conversion respectively of a first signal and of a second signal,
- a local oscillator connected to one of the two circuits, characterized in that said device comprises further:
- a second waveguide for the transmission of a signal of the local oscillator to the other of the two circuits for its use in the frequency conversion for the second circuit.

In this way, the invention avoids at least the duplication of certain components, in the case in point the local oscillator. The production cost is thus reduced by this. Furthermore, the microstrip links connecting the local oscillator to the circuit opposite would generate injection losses, causing degradation of the signal conveyed along these lines, whereas guided propagation of the signals minimizes these losses over the length of the waveguide, further economizing on the use of an amplifier.

If a single polarization is transmitted, the said first guide may be of parallelepipedal shape. According to a variant of the invention, the guide is cylindrical.

In order to maximize the energy delivered at the junctions between the second waveguide and the microstrip lines, the said second guide is closed at its ends by a quarter-wave cavity of length equal to one quarter of the guided wavelength of the transmitted signal. These quarter-wave cavities function as open circuits in the planes of the transmission and reception circuits for the waves to be delivered.

According to one embodiment, said first and second waveguides are interdependent with a same support.

According to one embodiment, said the first and second circuits are arranged on a first and a second microstrip circuit boards.

According to one embodiment, said coupling of the local oscillator connected to the one of the two circuits with the second waveguide and the coupling of this second waveguide with the other of the two circuits are realized by means of probes.

According to one embodiment, one of the frequency bands is used for the transmission of signals, and the second frequency band is used for the reception of signals.

According to one embodiment, the microstrip circuit boards cut the first waveguide in cross sections of said first guide.

According to one embodiment, the circuit board used for transmission is arranged upstream of the said circuit board used for reception in the signal reception direction of the device.

According to one embodiment, the circuit board used for transmission is arranged upstream of the said circuit board used for reception in the signal reception direction of the device.

According to one embodiment, the first waveguide comprises filtering means of type comprising a filter with iris cavity, a filter with screw cavity or a filter comprising at least two resonant cavities connected transversely to the body of the guide by coupling with irises, said filtering means being arranged in such a way that the waves transmitted by the first probe are attenuated enough on the second probe side in order not to interfere with the waves received at this second probe.

BRIEF DESCRIPTION OF THE DRAWINGS

Other characteristics and advantages of the present invention will become apparent from the description of the illustrative embodiments which follow and which are taken by way of non-limiting examples, with reference to the appended figures, in which.

DETAILED DESCRIPTION OF PREFERRED EMBODIMENTS

To simplify the description, the same references will be used in the various figures to denote those elements which fulfill identical functions.

Figure 1:
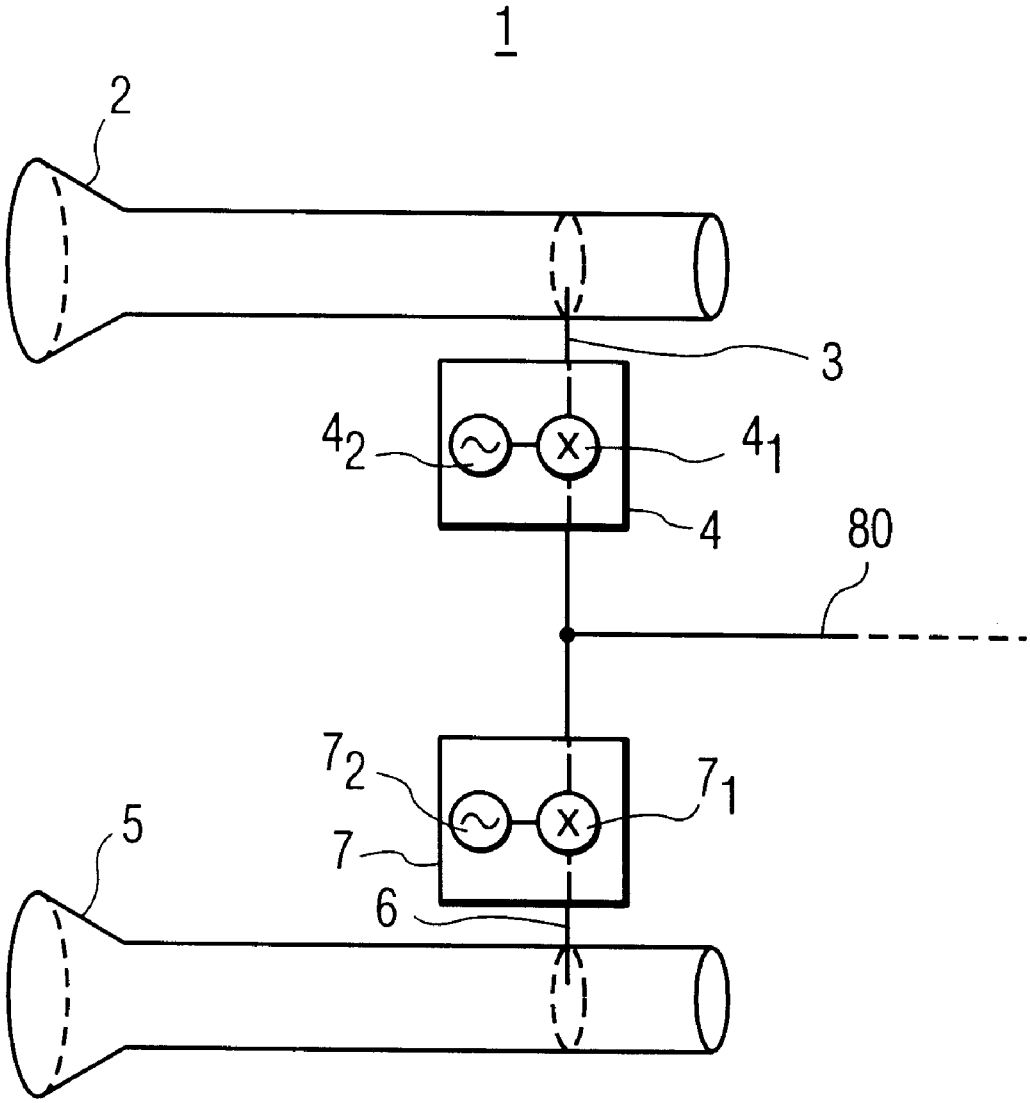
FIG. 1 PRIOR ART
FIG. 1, already described, represents a diagram of a transmission/reception device.
Figure 2:
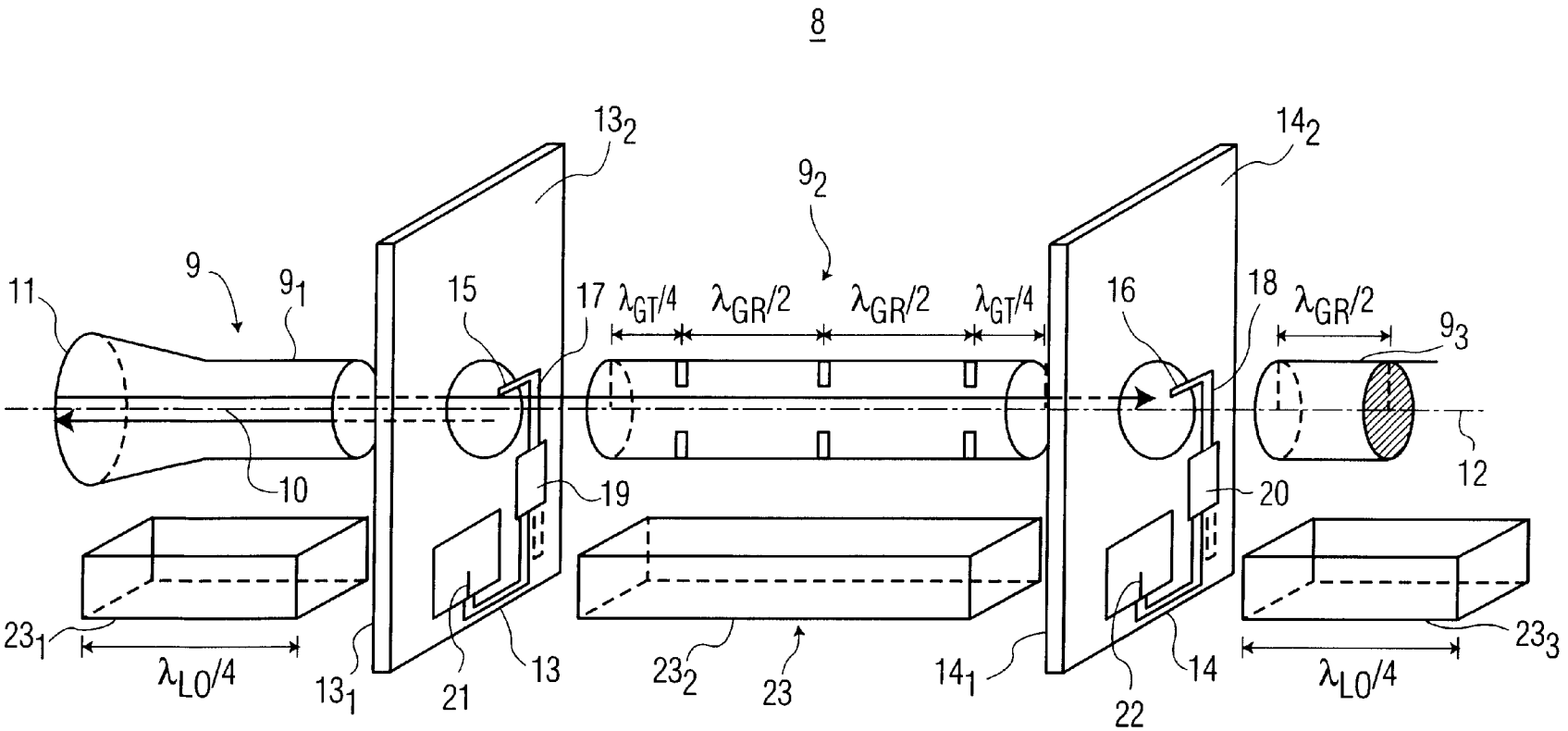
FIG. 2 represents a simplified exploded view of an embodiment according to the invention.
Figure 3:
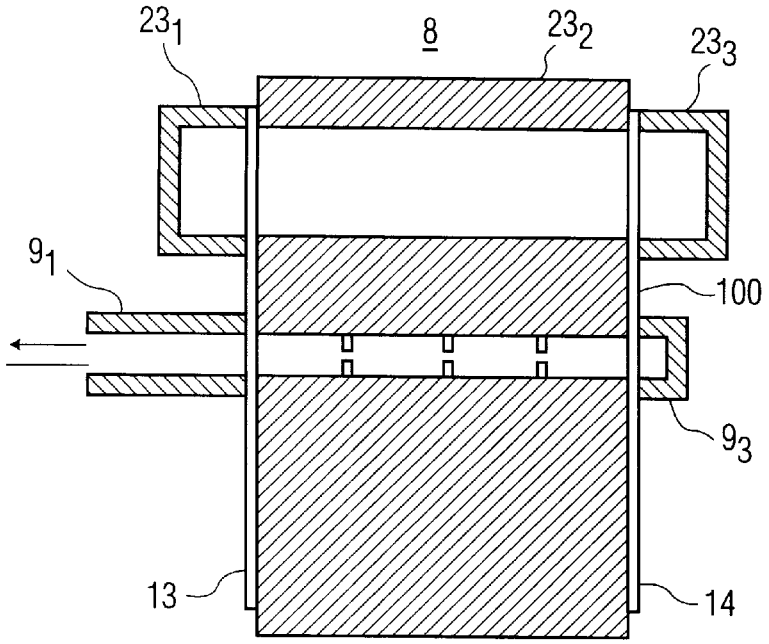
FIG. 3 represents a cross section of the embodiment in FIG. 2, FIG. 4 more particularly represents a unit for conversion to intermediate frequency which is arranged on the reception circuit, and a unit for conversion to higher frequency which is arranged on the transmission circuit, FIGS. 5.*a*, 5.*b*, 5.*c*, 5.*d* and 5.*e* schematically represent views of five embodiments of filtering means according to the invention.

FIG. 2 represents an embodiment of a device 8 according to the invention, whereas FIG. 3 represents a cross section of the device 8 in FIG. 2. The device comprises a cylindrical cap 9 whose open end is arranged at the focus 10 of a parabola (not shown). The open end of the cap 9 extends in a frustoconical part or horn 11 which has discontinuities or grooves allowing good reception/transmission of the signals, which discontinuities are known per se and have not been represented. The cap 9 of the guide is separated into three parts $\mathbf{9}_1$, $\mathbf{9}_2$ and $\mathbf{9}_3$. Part $\mathbf{9}_1$ is connected to the horn 11, part $\mathbf{9}_2$ is the central part of the cylindrical cap 9, and part $\mathbf{9}_3$ is the end part of the guide 9, comprising a resonant cavity. Between the first and the second guide parts $\mathbf{9}_1$ and $\mathbf{9}_2$, a microstrip circuit board 13 for transmitting the signals to be transmitted is arranged transversely with respect to a principal axis 12 of the guide 9, and between the second and third guide parts $\mathbf{9}_2$ and $\mathbf{9}_3$, a microstrip circuit board 14 for receiving the said signals is arranged transversely with respect to the axis 12. These two boards 13 and 14, each forming a substrate, consist of a material which has a given dielectric permitivity and is known per se. The said boards 13 and 14 have respective upper surfaces $\mathbf{13}_1$, $\mathbf{14}_1$ turned towards the space where the energy is to be regulated or picked up, and lower surfaces $\mathbf{13}_2$, $\mathbf{14}_2$ corresponding to the other face of the substrate. The lower surfaces $\mathbf{13}_1$, $\mathbf{14}_1$ are metallized, forming an earth plane, and are in contact with the conductive walls of the guide 9. The boards 13 and 14 are respectively supplied by a probe 15 and 16, which are respectively etched on the lower surfaces $\mathbf{13}_2$, $\mathbf{14}_2$ of the boards 13 and 14 and which penetrate inside the perimeter of the guide 9 through openings, without touching the wall of the guide 9.

In a variant of the invention (not shown) to permit the reception and transmission of orthogonally polarized waves, two probes are etched on each of the said substrates and are arranged at right angles to one another.

The guide part $\mathbf{9}_3$ closing the guide 9 is a quarter-wave $\lambda_{GR}/4$ guide section which forms a resonant cavity and operates as an open circuit in the plane of the substrate 14 for the received waves, $\lambda_{GR}$ representing the guided wavelength of the received wave. In contrast, the guide part $\mathbf{9}_2$ is an electromagnetic filter making it possible to isolate the probe 16 from the energy leaks due to the waves broadcast by the probe 15. Various embodiments of this filter $\mathbf{9}_2$ are described in FIGS. 5*a* to 5*e*.

Figure 4:
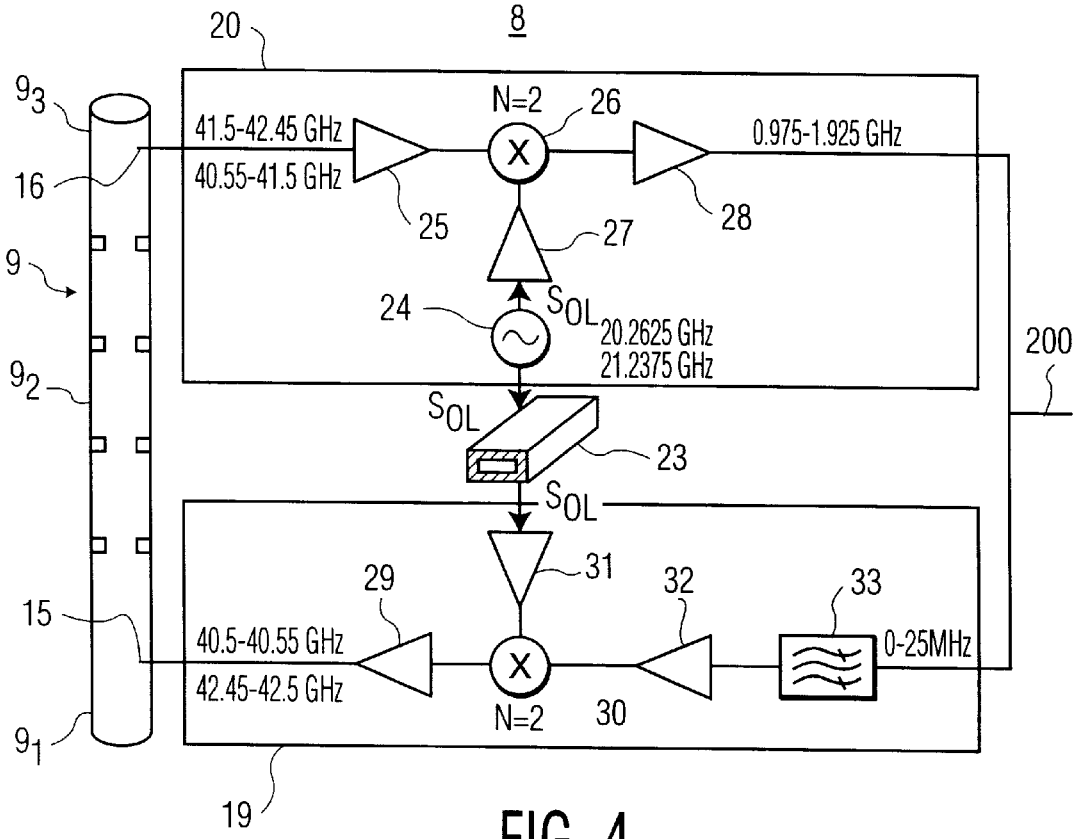

These two probes 15 and 16 are connected, on the boards 13 and 14 by microstrip lines 17, 18 whose technology is known per se, respectively to a unit for conversion to high frequency, referred to as the transmission unit 19, and a unit for conversion to intermediate frequency, or reception unit 20. The transmission 19 and reception 20 units, which are represented in detail in FIG. 4, are connected by means of a coaxial cable 200 represented in FIG. 4 to an indoor set located inside a dwelling (not shown) represented in FIG. 6. The units 19, 20 are also respectively connected to probes 21, 22 which penetrate inside the perimeter of rectangular openings in the substrates 13, 14. The two boards 13, 14 delimit, on either side of the probe and the rectangular opening which correspond to them, three parts $\mathbf{23}_1$, $\mathbf{23}_2$ and $\mathbf{23}_3$ of a cap 23 which has a rectangular cross section and forms a waveguide of parallelepipedal shape. In order to maximize the energy delivered at the junctions between the cap $\mathbf{23}_2$ guiding the transmitted waves and the microstrip probes of the transmission 13 and reception 14 boards, the cap $\mathbf{23}_2$ is closed at its ends by the parts $\mathbf{23}_1$ and $\mathbf{23}_3$ which each form a quarter-wave ($\lambda_{LO}/4$) cavity of length equal to one quarter of the guided wavelength ($\lambda_{LO}$) corresponding to a signal $S_{OL}$ of frequency $F_{LO}$ generated by a local oscillator 24, the role of which will be explained below, These parts $\mathbf{23}_1$ and $\mathbf{23}_3$ respectively function as open circuits in the planes of the substrates 13 and 14 for the waves transmitted at the frequency of the said local oscillator 24.

In FIG. 4, the probe 16 is connected to a low-noise amplifier 25 which receives signals in the [41.5 GHz; 42.45 GHz] band and whose output is connected to a first input of a mixer 26. A second input of this mixer 26 is driven by the oscillator 24 of frequency 20.2625 GHz via an amplifier 27 which amplifies a band centred on the frequency of the oscillator 24. The output of the subharmonic mixer 26 of harmonic N=2 delivers signals which are amplified by an intermediate-frequency amplifier 28. The output of this intermediate-frequency amplifier 28 then delivers signals in a [975 MHz–1925 MHz] band.

Similarly, the probe 15 is connected to a power amplifier 29 whose input is connected to the output of a subharmonic mixer 30 of harmonic N=2. A first input of this mixer 30 is driven by a signal delivered by an amplifier 31, and a second input is connected to the output of an amplifier 32 whose input is connected to the output of a bandpass filter 33 whose pass band is [0; 25 MHz]. The input of the amplifier 31 is connected to the probe 21. In the same way, the probe 22 is connected to a second output of the oscillator 24. The signal generated by the local oscillator 24 is then transmitted by the probe 22 into the waveguide 23 and picked up at the probe 21 to be recovered in the high-frequency conversion unit 19.

Figure 5A:
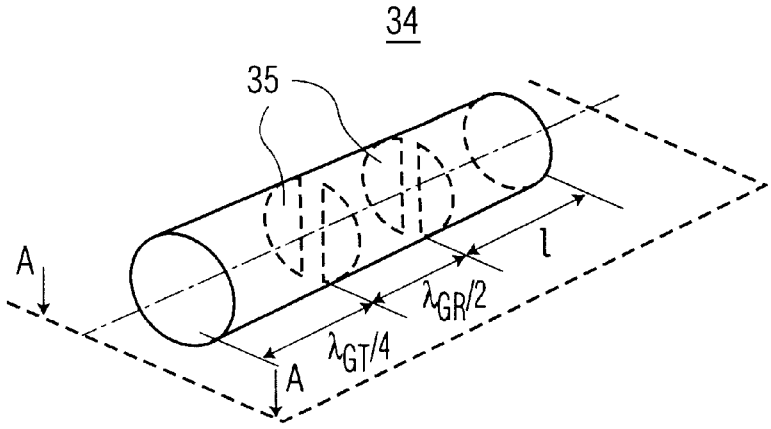

FIG. 5*a* represents a bandpass filter 34 using several resonant cavities coupled inductively by irises 35. The distance between two consecutive irises 35 in the length direction of the guide 9 is chosen so that the reflections between the two irises cancel each other out at the resonant frequency of the cavity. This distance is of the order of $\lambda_{GR}/2$, $\lambda_{GR}$ being the guided wavelength of the frequencies received by the probe 16. The bandpass filter 34 produced in this way, furthermore having a quarter-wave $\lambda_{GT}/4$ guide section at its input, $\lambda_{GT}$ being the wavelength of the frequencies broadcast by the probe 15, can be considered as an open circuit for the energy radiated by the probe 15 in the plane of the substrate 13, and does not filter for the received-frequency band. It has been deemed expedient to introduce several successive cavities separated by irises 35, this making it possible to improve the frequency response of the filter 34, allowing sharper cutoff. By way of explanation, as the number of irises 35 increases, the frequency response of the filter 34 becomes steeper. In view of the compromise between the performance which is obtained by increasing the number or irises 35 and the complexity which may result from this, it is preferable to use a filter 34 containing fewer than 10 irises 35. It should be noted that the distance I separating the last iris and the board 14 is arbitrary, this also being true for the filters below.

Figure 5B:
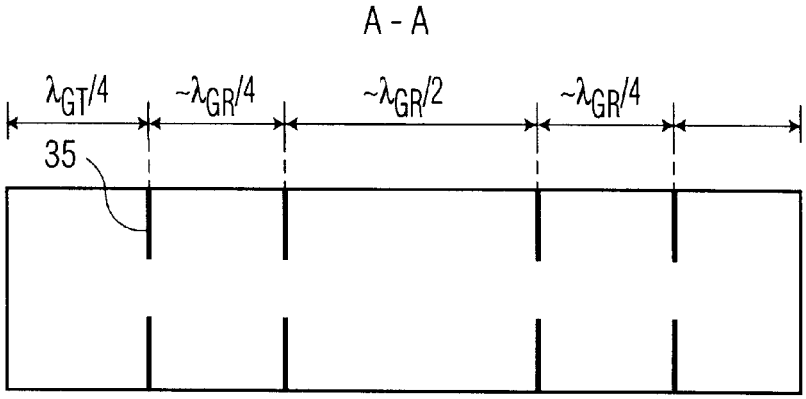

FIG. 5*b* is a longitudinal section of a variant of the bandpass filter 34 in the view A—A.

Figure 5C:
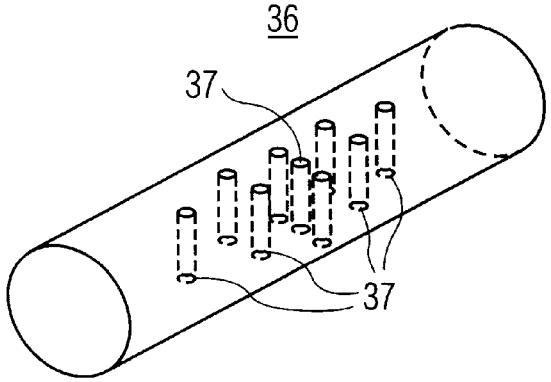

FIG. 5*c* represents a bandpass filter 36 produced using a succession of screws 37. In order to allow fine adjustment of the resonant frequency of each cavity to be made, these screws 37, which have variable insertion and behave as capacitive susceptances, are placed so as to make it possible to optimize the setting of the filter 36.

Figure 5D:
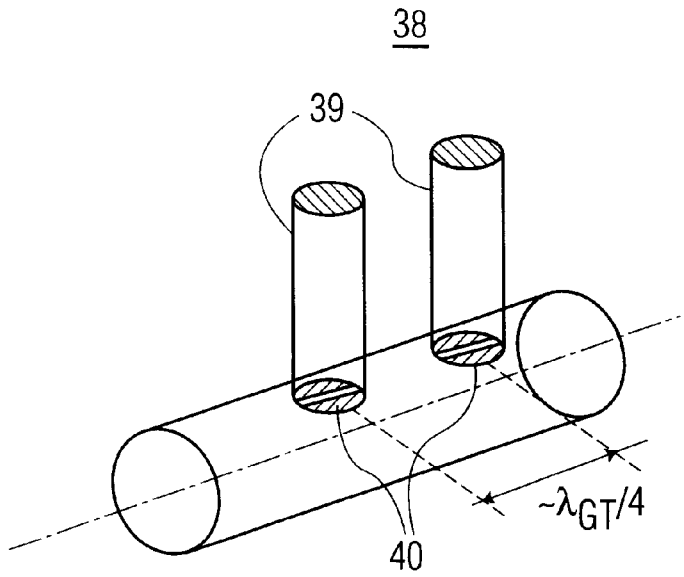

FIG. 5*d* represents a notch filter 38. This filter 38 is produced by using resonant cavities 39 which are connected transversely to the body of the guide $\mathbf{9}_2$ by coupling with irises 40. The distance between these cavities is of the order of one quarter of the guided wavelength of the waves broadcast by the probes 15.

Figure 5E:
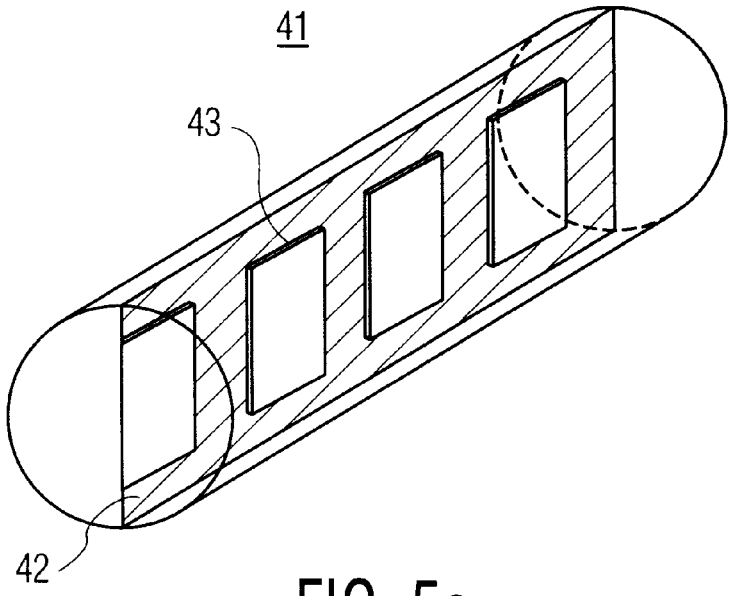

FIG. 5*e* represents a bandpass filter 41 called a finline. These filters 41 are easy to produce by inserting a metallized substrate 42, which has windows 43, in the E plane of the waveguide 9. A metal plate having identical geometry to the said substrate 42 may also be used.

In the embodiment in FIG. 2, for a device 8 for transmission/reception of signals in the band around 40 GHz, the diameter of the cross section of the guide 9 is 4.8 mm. In order to make it possible to convey a signal around 20 GHz, corresponding to the frequency of the local oscillator 24 shared between the transmission 13 and reception 14 circuits, the short dimension of the rectangular guide 23 is 4.3 mm whereas its long dimension is 10.7 mm. The length between the transmission 13 and reception 14 circuits is 8 cm.

These numerical values do not of course imply any limitation.

Figure 6:
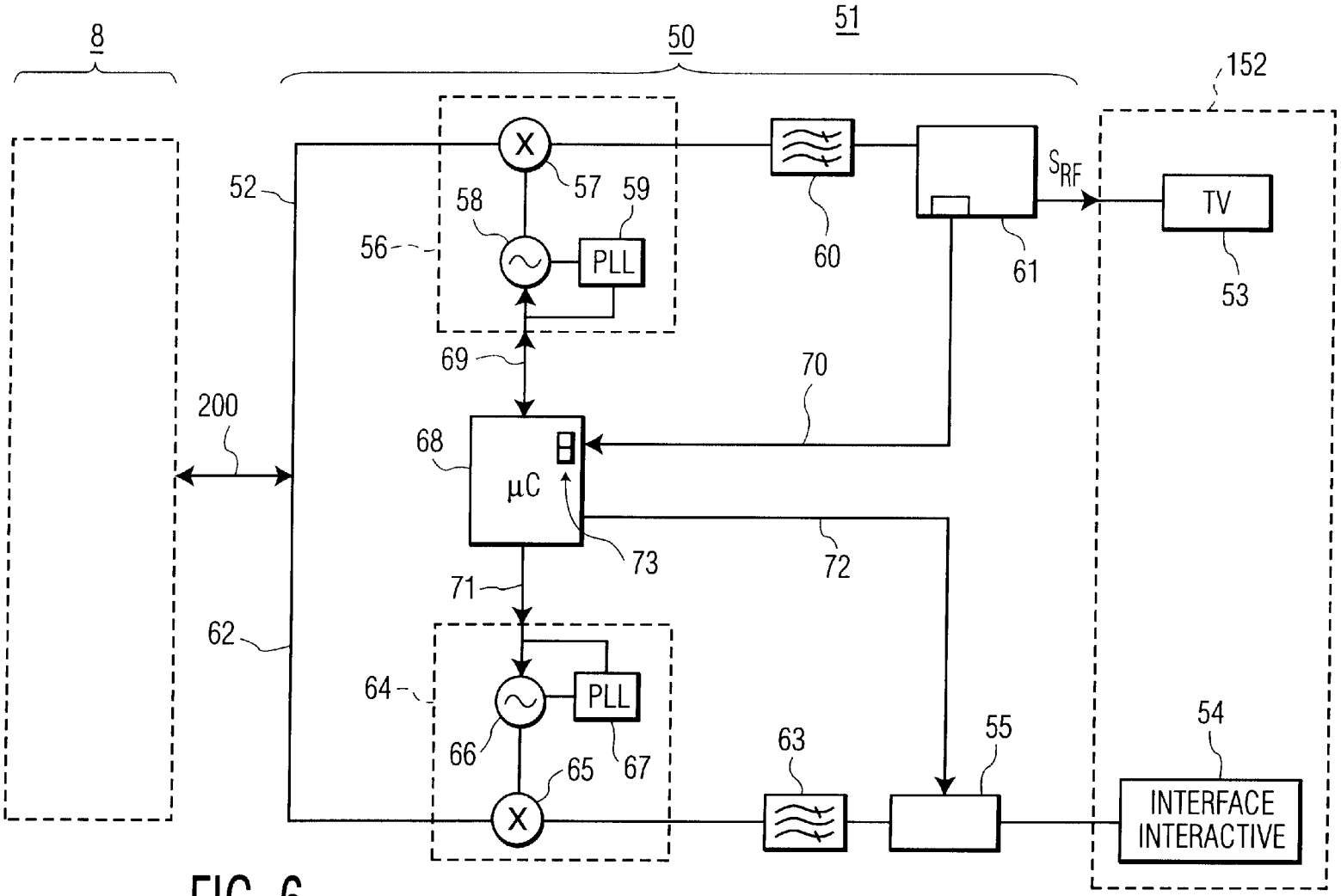
FIG. 6 represents a device for transmission/reception of signals comprising a frequency drift compensator according to the invention.

FIG. 6 represents a device 50 for transmission/reception of signals comprising a frequency drift compensator according to the invention. This device 50 is contained in the interior set 51 located inside the dwelling. This device 50 is capable of detecting the frequency drift which the oscillator 24 suffers on the reception path, and makes it possible to offset the return channel so as to centre it on the return channel.

In FIG. 6, the input/output of the said interior set 51 is connected to a reception path 52 whose general role is, amongst other things, to carry out the conversions to low frequency and to decode the encrypted video signals which originates from the exterior set and are sent to the coaxial cable 200, in the same way as a conventional interior set. The decoded signals available at the output of this interior set 51 are then sent to one of its outputs, at which an assembly 152 is connected. The input of the assembly 152 is connected to a television receiver 53 and a remote control 54 with the role of an active interface makes it possible to send instructions generated by the user to a modulator 55.

The input of the reception path 52 is connected to a reception frequency tuner comprising a frequency converter circuit 56 (referred to below as "converter") which is known per se. The converter 56 comprises a mixer 57, a first input of which receives the signal originating from the input of the reception path 52 and a second input of which is driven by a local oscillator 58 controlled by a phase-locked loop circuit 59, referred to below as PLL. The output of a mixer 57, which is the output of the converter 56, is connected to an input of a bandpass filter 60 whose passband is substantially centred on the nominal value of the reception band of a demodulator/decoder 61. The output of the demodulator/decoder 61 produces a television signal $S_{RF}$ which is sent to the television receiver 53.

The interactive interface 54 delivers packets on a return path 62 of the interior set 51 through the modulator 55 which performs modulation of the QPSK type. The output of the modulator 55 is connected to an input of a bandpass filter 63 centred on the transmission frequency of the interface 54. The output of the filter 63 is connected to a transmission frequency tuner of the device, consisting of a frequency converter circuit 64. The converter 64 comprises a mixer 65, one input of which receives the signal originating from the filter 63 and a second input of which is driven by a local oscillator 66 controlled by a PLL circuit 67. The output of the converter circuit 64, which is the output of the mixer 65, has the role of sending the transmitted signals via the coaxial cable 200 to the device 8 of the exterior set. The local oscillator 66 delivers a sinewave signal at the desired frequency or transmission channel.

The device 50 was the subject of a patent application filed in the name of the Applicant Company on Oct. 31, 1997, having the number 9713708. It comprises a compensator comprising a digital module for automatic frequency correction, consisting of a microcontroller 68 in the embodiment represented. The microcontroller 68 is capable of recording the total frequency drift $\delta F_{10}$ introduced on the reception path 52 and of offsetting the spectrum of the transmission signal by a value $(-\delta F_{10})$ so as to match the frequency of the carrier of the said signal to the nominal frequency of the carrier of the transmission channel. This microcontroller 68 receives and transmits digital signals with the PLL circuit 59 downlinked via a first control/drive bus 69, receives digital signals from the demodulator/decoder unit 61 via a second control/drive bus 70, transmits digital signals intended for the PLL circuit 67 uplinked there via a third control/drive bus 71 and for the modulator/encoder 55 via a fourth control/drive bus 72, as shown by FIG. 6.

In the embodiment described in FIG. 6, the microcontroller 68 comprises a memory 73 which can record two digital values used for controlling the carrier of the signal transmitted on the transmission path in relation to the nominal frequency of the carrier of the uplink channel. The way in which the interior set 51 and, in particular, the frequency drift compensation module operate will not be described in the present application, and can be found in the aforementioned patent application No. 9713708 in the name of the Applicant Company dated Oct. 31, 1997.

The device 8 according to the invention operates as follows.

The electromagnetic waves arriving on the reflector (not shown) of the transmission/reception system according to the invention are focused on its focus 10 to be guided along the guide 9. These waves pass through the filter $\mathbf{9}_2$, which may be a bandpass filter allowing only the reception frequency band through, a notch filter cutting off the transmission frequency band or a high pass filter, or a low pass filter, respectively, in the case when the transmission band is chosen, in the frequency plane, so that the transmission frequencies are lower, or higher, respectively, than the reception frequencies. The said waves are then received and picked up by the probe 16 which delivers to the conversion unit 20 a reception signal which, after conversion to intermediate frequencies, is intended to be sent to the interior unit 51 of the dwelling. This signal is then processed in the device 50 to be utilized in the receiver 53.

Simultaneously, a return signal which originates from the device 50 and is frequency-rectified using the method explained in French Patent Application No. 9713708, passes through the unit 19 for conversion to high frequency, which supplies the probe 15 with the waves to be broadcast to the horn 11. The energy radiated by this probe 15 at the filter $\mathbf{9}_2$ side is attenuated by the filter so that the leaks of the transmitted waves are small enough not to cause interference for the reception board 14. By way of example, interference will be considered to be negligible if the waves broadcast by the probe 15 are attenuated by 70 dB below their initial level during transmission on the reception board $\mathbf{14}_2$ side.

During the conversion of the signal received by the unit 20, the oscillator 24 contained in the unit 20 generates an oscillation signal $S_{OL}$ of frequency $F_{LO}$ allowing the said signals to be transposed into the intermediate band. The same oscillator 24 generates a second signal $S_{OL}$ with the same frequency $F_{LO}$ which is supplied to the probe 22. The latter transmits, via the waveguide $\mathbf{23}_2$, the said signal which is picked up at the probe 21. The probe 21 has the task of delivering it to the input of the amplifier 31 for transposing the transmission signals in the uplink path to high frequency.

The guided propagation of the oscillatory signal $S_{OL}$ generated by the oscillator 24 makes it possible to use a single common local oscillator 24 for the transmission and reception paths.

Various other configurations may clearly be envisaged in the established frequency plane, for example:

a reception band [40.55 GHz; 41.5 GHz] and a transmission band [42.45 GHz; 42.5 GHz], a reception band [41.5 GHz; 42.45 GHz] and a transmission band [40.5 GHz; 40.55 GHz].

At these high reception/transmission frequencies, current filters $\mathbf{9}_2$ need to be provided with a frequency space of about one gigahertz between the reception band and the transmission band. The various frequency plane configurations, as well as others which have not been mentioned, need to satisfy this condition.

It is remarkable that the two waveguides are interdependent to a same support 100 which makes the device according to the invention be small and compact structure.

Of course, the invention is not limited to the embodiments as described. Thus, the guides 9 and 23 may be of any shape allowing good reception/transmission of the electromagnetic waves. By way of example, they may be rectangular if one polarization is favoured over another. The horn 11 may furthermore be of any kind, for example a grooved horn.

It is also possible to use guided propagation means for sending a signal other than an oscillatory signal.

It is also well possible to use the two circuit boards for the reception only or for the emission only of signals.

What is claimed is:

1. Device for transmission and/or reception of signals, comprising:

a first waveguide for the operation in a first frequency band and the operation in a second frequency band, a first frequency conversion circuit and a second frequency conversion circuit coupled with the first waveguide for the frequency conversion respectively of a first signal and of a second signal, a local oscillator connected to one of the two circuits, wherein said device further comprises:

a second waveguide for the transmission of a signal of the local oscillator to the other of the two circuits for its use in the frequency conversion of the other of two circuits.

2. Device according to claim 1, wherein said first and second waveguides are interdependent with a same support.

3. Device according to claim 2, wherein the first and second circuits are arranged on a first and a second microstrip circuit boards.

4. Device according to claim 3, wherein the coupling of the local oscillator connected to one of the two circuits with the second waveguide and the coupling of this second waveguide with the other of the two circuits are realized by means of probes.

5. Device according to claim 2, wherein the coupling of the local oscillator connected to one of the two circuits with the second waveguide and the coupling of this second waveguide with the other of the two circuits are realized by means of probes.

6. Device according to claim 1, wherein the coupling of the local oscillator connected to the one of the two circuits with the second waveguide and the coupling of this second waveguide with the other of the two circuits are realized by means of probes.

7. Device according to claim 1, wherein one of the frequency bands is used for the transmission of signals, and the second frequency band is used for the reception of signals.

8. Device according to claim 1, wherein said second guide is closed at its ends by a quarter-wave ($\lambda_{LO}/4$) cavity of length equal to one quarter of the guided wavelength ($\lambda_{LO}$) of the transmitted signal.

9. Device according to claim 1, wherein the first waveguide comprises filtering means of type comprising a filter with iris cavity, a filter with screw cavity or a filter comprising at least two resonant cavities connected transversely to the body of the guide by coupling with irises, said filtering means being arranged in such a way that the waves transmitted by a first probe are attenuated enough on a second probe side in order not to interfere with the waves received at this second probe.

10. Device according to claim 1, wherein the first and second circuits are arranged on a first and a second microstrip circuit boards.

11. Device according to claim 10, wherein the microstrip circuit boards cut the first waveguide in cross sections of said first guide.

12. Device according to claim 11, wherein the circuit board used for transmission is arranged upstream of the said circuit board used for reception in the signal reception direction of the device.

13. Device according to claim 10, wherein the coupling of the local oscillator connected to the one of the two circuits with the second waveguide and the coupling of this second waveguide with the other of the two circuits are realized by means of probes.

14. Device according to claim 10, wherein one of the frequency bands is used for the transmission of signals, and the second frequency band is used for the reception of signals.

15. Device according to claim 14, wherein said second guide is closed at its ends by a quarter-wave ($\lambda_{LO}/4$) cavity of length equal to one quarter of the guided wavelength ($\lambda_{LO}$) of the transmitted signal.

* * * * *